US006116867A

United States Patent [19]

Wallis et al.

[11] Patent Number: 6,116,867

[45] Date of Patent: Sep. 12, 2000

[54] SCROLL MACHINE WITH CAPACITY MODULATION

[75] Inventors: Frank S. Wallis; Stanley P. Schumann, both of Sidney; Jeffrey L. Berning, Fort Loramie, all of Ohio

[73] Assignee: Copeland Corporation, Sidney, Ohio

[21] Appl. No.: 09/009,012

[22] Filed: Jan. 16, 1998

[51] Int. Cl.[7] ..... F04B 23/00

[52] U.S. Cl. ..... 417/440; 417/213; 417/505

[58] Field of Search ..... 417/440, 213, 417/505

[56] References Cited

U.S. PATENT DOCUMENTS

| | | | |
|---|---|---|---|
| 4,383,805 | 5/1983 | Teegarden et al. . | |
| 4,456,435 | 6/1984 | Hiraga et al. . | |
| 4,468,178 | 8/1984 | Hiraga et al. . | |
| 4,497,615 | 2/1985 | Griffith . | |
| 4,514,150 | 4/1985 | Hiraga et al. . | |
| 4,566,863 | 1/1986 | Goto et al. . | |
| 4,673,340 | 6/1987 | Mabe et al. . | |
| 4,747,756 | 5/1988 | Sato et al. . | |
| 4,767,293 | 8/1988 | Caillat et al. | 418/55 |
| 4,846,633 | 7/1989 | Suzuki et al. | 417/310 |
| 4,877,382 | 10/1989 | Caillat et al. | 418/55 |
| 4,992,033 | 2/1991 | Caillat et al. | 418/55.3 |
| 5,074,760 | 12/1991 | Hirooka et al. . | |
| 5,074,761 | 12/1991 | Hirooka et al. . | |
| 5,102,316 | 4/1992 | Caillat et al. | 418/55.5 |
| 5,192,195 | 3/1993 | Iio et al. . | |
| 5,336,058 | 8/1994 | Yokoyama | 417/299 |
| 5,407,335 | 4/1995 | Caillat et al. | 418/55.1 |
| 5,551,846 | 9/1996 | Taylor et al. | 417/308 |
| 5,562,426 | 10/1996 | Watanabe et al. . | |
| 5,678,985 | 10/1997 | Brooke et al. | 417/299 |

FOREIGN PATENT DOCUMENTS

| | | |
|---|---|---|
| 3-202691 | 9/1991 | Japan . |

*Primary Examiner*—Timothy S. Thorpe
*Assistant Examiner*—David J. Torrente
*Attorney, Agent, or Firm*—Harness, Dickey, Pierce, P.L.C.

[57] ABSTRACT

A scroll-type compressor having a capacity modulation system of the delayed suction type is disclosed which incorporates a valving ring rotatably supported on one of the scroll members. Seals are provided acting between the valving ring and scroll member which serve to effect a fluid tight sealing relationship therebetween when the compressor is operating in a full capacity mode thus reducing the need for maintaining tight tolerances during manufacture of the valving ring.

26 Claims, 5 Drawing Sheets

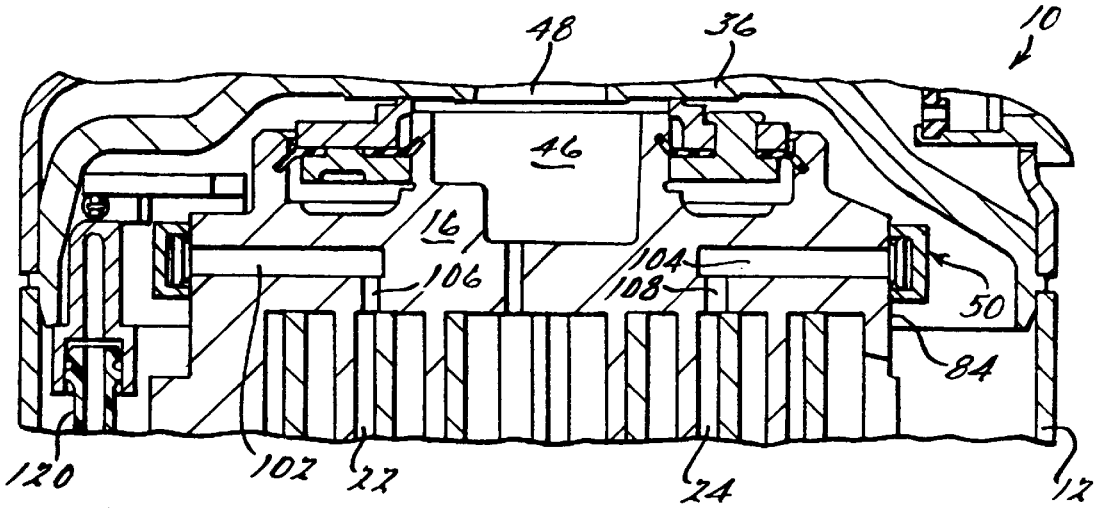
FIG. 2.
FIG. 3.
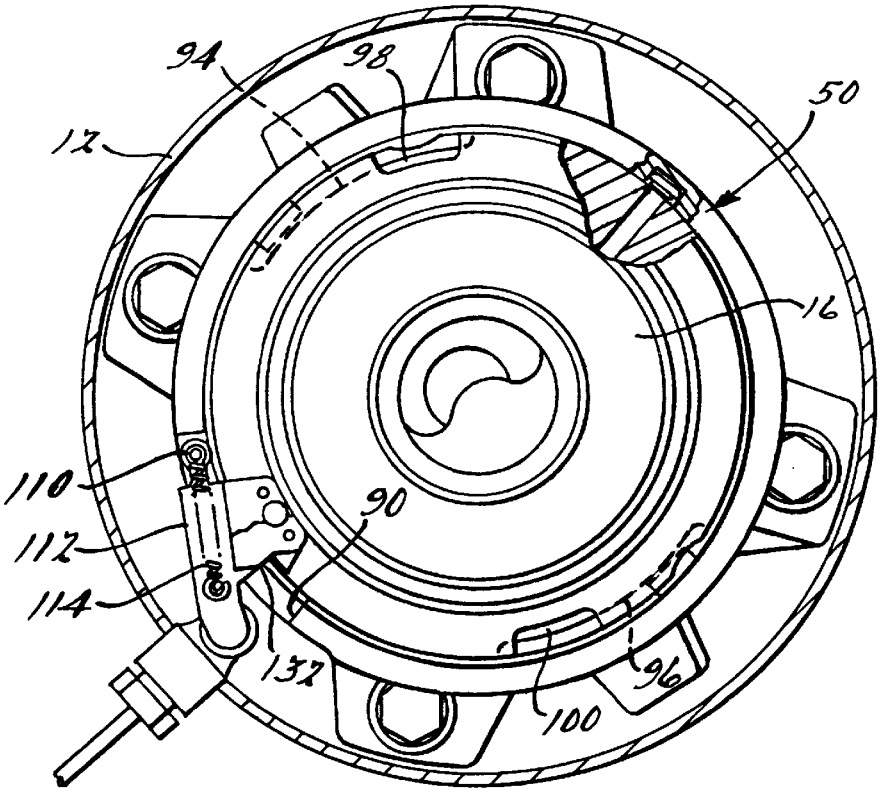

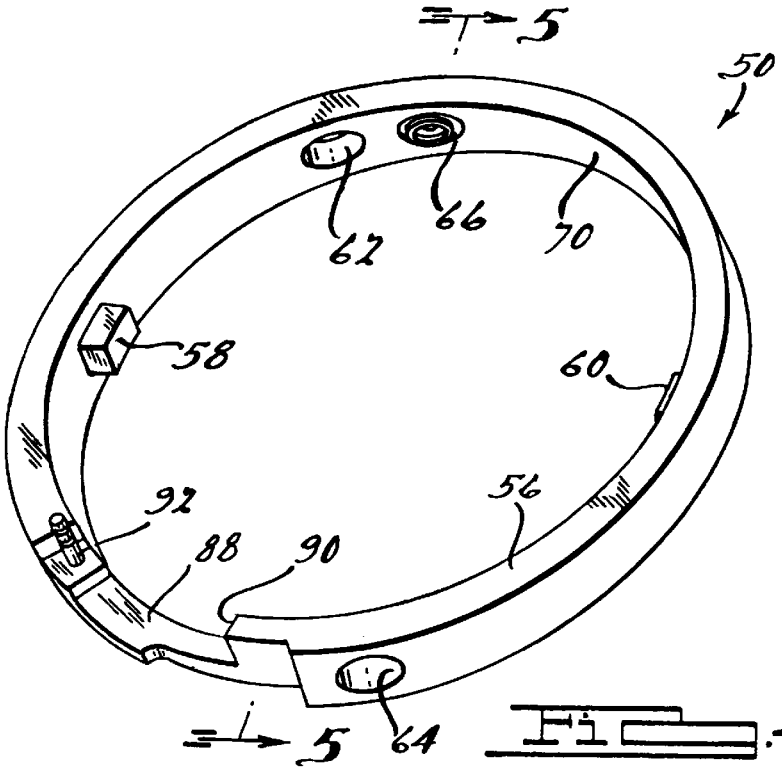
FIG. 4.
FIG. 5.
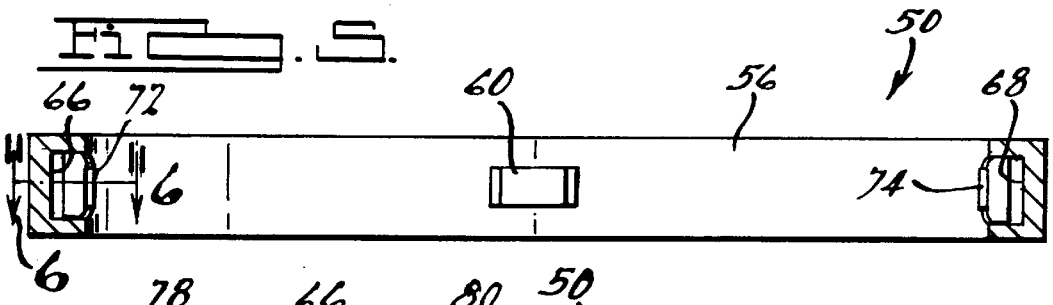
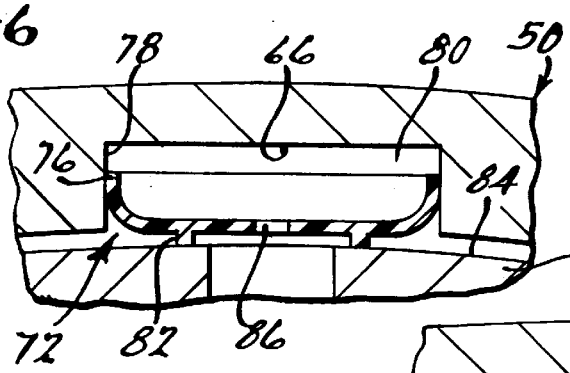
FIG. 6.
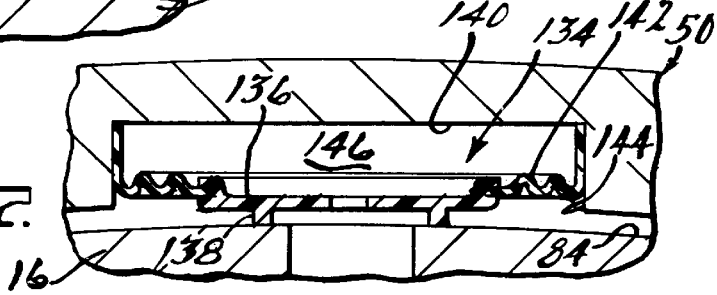
FIG. 7.

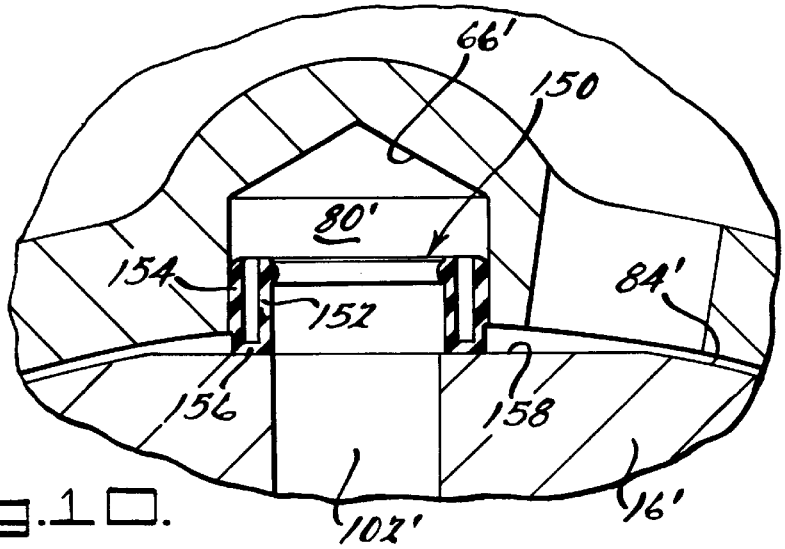
FIG. 10.
FIG. 11.
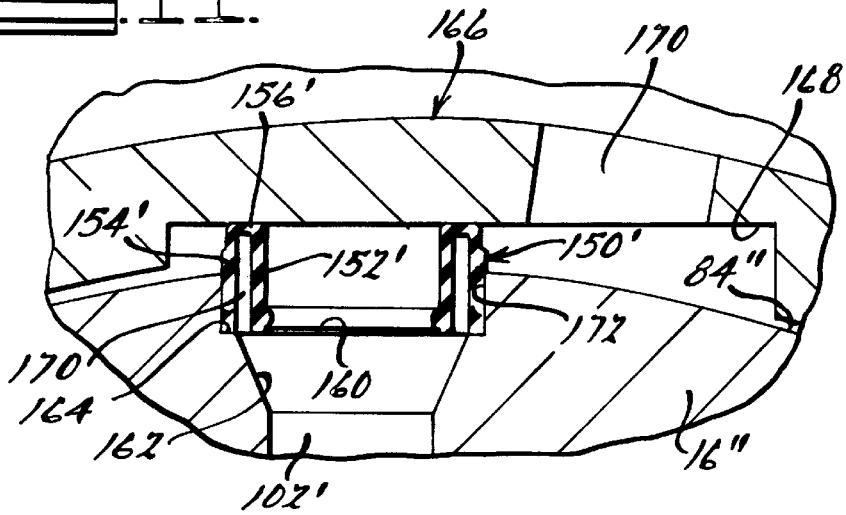
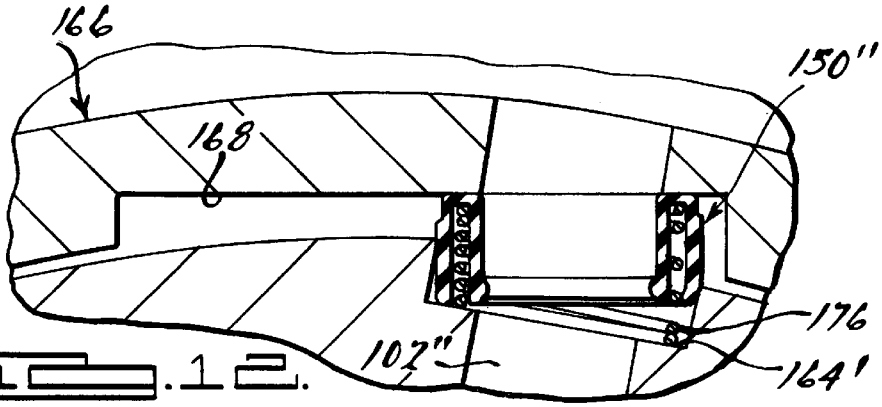
FIG. 12.

SCROLL MACHINE WITH CAPACITY MODULATION

BACKGROUND AND SUMMARY OF THE INVENTION

The present invention relates generally to scroll compressors and more specifically to scroll compressors incorporating capacity modulation systems of the delayed suction type.

A wide variety of systems have been developed in order to accomplish capacity modulation most of which delay the point at which compression of the fluid in the moving fluid pockets begins. In one form, such systems commonly employ a pair of vent passages communicating between suction pressure and the outermost pair of moving fluid pockets. Typically these passages open into the moving fluid pockets at a position normally within 360° of the sealing point of the outer ends of the wraps. Some systems employ separate solenoid valves for each such vent passage which valves are intended to be operated simultaneously so as to ensure a pressure balance between the two fluid pockets. Other systems employ additional passages to place the two vent passages in fluid communication thereby enabling use of a single valve to control capacity modulation.

More recently a capacity modulation system of the delayed suction type for scroll compressors has been developed in which a valving ring is movably supported on the non-orbiting scroll member. An actuating piston is provided which operates to rotate the valving ring relative to the non-orbiting scroll member to thereby selectively open and close one or more vent passages which communicate with selective ones of the moving fluid pockets to thereby vent the pockets to suction. A scroll-type compressor incorporating this type of capacity modulation system is disclosed in U.S. Pat. No. 5,678,985 the disclosure of which is hereby incorporated by reference.

While this system provides an extremely efficient means by which to modulate the capacity of scroll compressors, the need to minimize or prevent leakage past the valving ring when the compressor is in a full capacity operating mode requires tight manufacturing tolerances between the interfitting ring and scroll surfaces. If the clearances are too tight, it is possible that the valving ring may bind whereas if the clearances are too great, there will be excessive leakage. Further, maintaining such tight tolerances results in increased manufacturing costs. Of course, if the clearances are relaxed, the increased leakage resulting will reduce the efficiency of the compressor.

The present invention overcomes these disadvantages by incorporating individual seals associated with the valving ring which are designed to effectively prevent fluid leakage from the vent passages when the compressor is in a fill load operating mode. By utilizing such seals, the manufacturing tolerances between the valving ring and scroll member may be relaxed thereby reducing the manufacturing costs while still maintaining the desired high level of operating efficiency. In one form the seals are mounted on and movable with the valving ring. In another embodiment, the seals are mounted on the non-orbiting scroll in surrounding relationship to the vent passages provided therein. Preferably the seals will be structured such that the fluid pressure from the vent passages will act to bias the seals into sealing engagement with the opposed surface. Alternatively, a biasing spring may be utilized to aid in biasing the seal. Additionally, a localized flat may be provided on the facing surface against which the seals seat to further facilitate sealing engagement therebetween.

Additional advantages and features of the present invention will become apparent from the subsequent description and the appended claims taken in conjunction with the accompanying drawings.

BRIEF DESCRIPTION OF THE DRAWINGS

FIG. 2 is a fragmentary section view of the compressor of FIG. 1 but showing the valving ring in a closed position;

FIG. 3 is a plan view of the compressor of FIG. 1 with the outer shell and muffler plate removed therefrom;

FIG. 4 is a perspective view of the valving ring incorporated in the compressor of FIG. 1;

FIG. 5 is a section view of the valving ring of FIG. 4, the section being taken along line 5—5 thereof;

FIG. 6 is an enlarged section view of the ring shown in FIG. 5, the section of the ring being taken along line 6—6 thereof and showing the ring in operative relationship to a portion of the non-orbiting scroll member;

FIG. 7 is a view similar to that of FIG. 6 but showing another embodiment of the valving ring;

FIG. 10 is an enlarged fragmentary detail view of a portion of the valving ring of FIGS. 8 and 9;

FIG. 11 is a fragmentary section view of a portion of the non-orbiting scroll member and associated valve ring illustrating a further embodiment of the present invention with the valving ring shown in a closed position; and FIG. 12 is a view similar to that of FIG. 11 but showing another embodiment of the present invention with the valving ring being shown in an open position.

DESCRIPTION OF THE PREFERRED EMBODIMENTS

Figure 1:
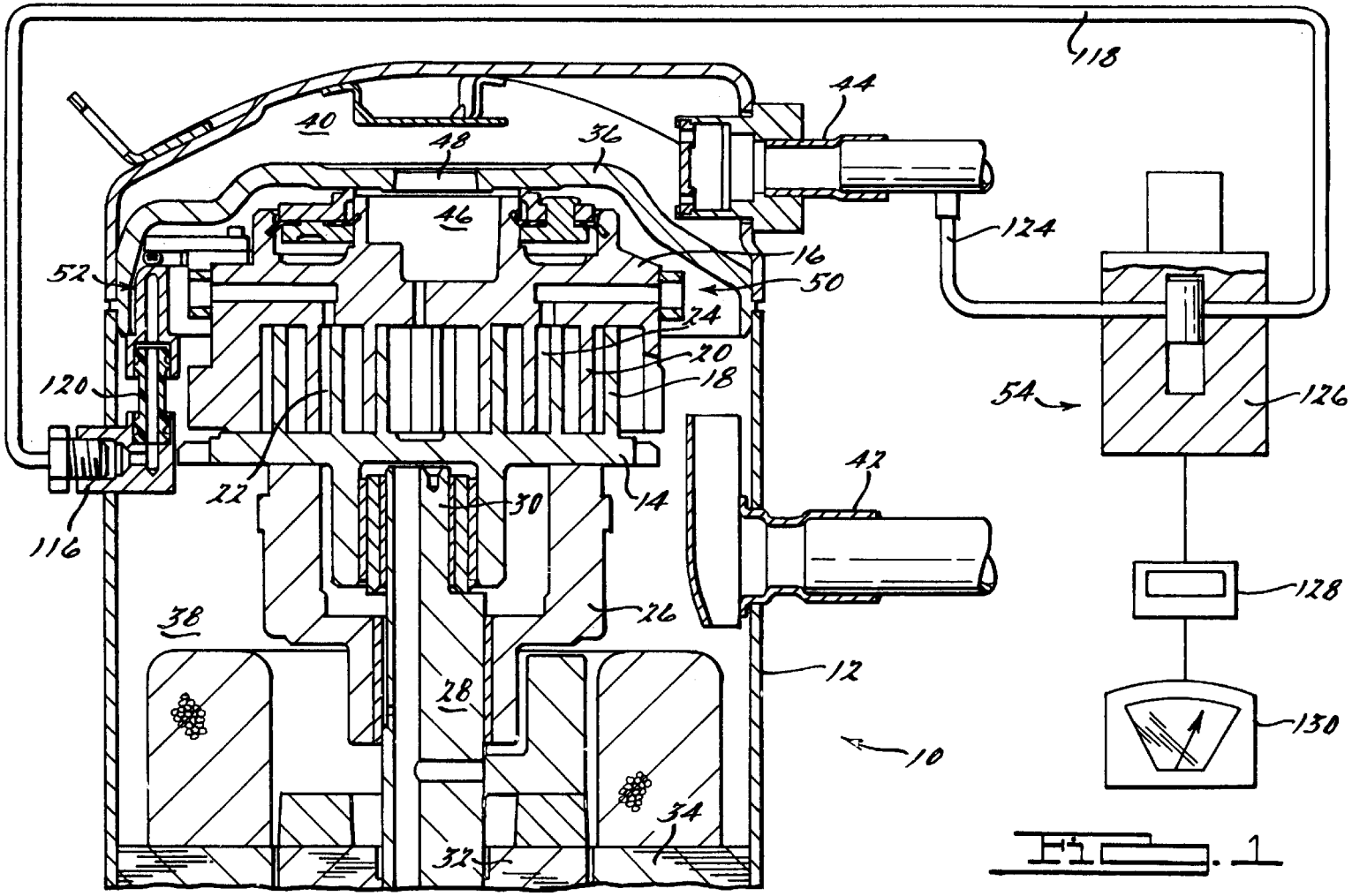
FIG. 1 is a fragmentary section view of a compressor incorporating the improved valve ring with the valving ring shown in a reduced capacity or open position, all in accordance with the present invention.

Referring now to the drawings and in particular to FIG. 1, there is shown a hermetic scroll-type refrigeration compressor indicated generally at 10 incorporating a capacity modulation system in accordance with the present invention.

Compressor 10 is generally of the type disclosed in U.S. Pat. No. 4,767,293 issued Aug. 30, 1988 and assigned to the same assignee as the present application the disclosure of which is hereby incorporated by reference. Compressor 10 includes an outer shell 12 within which is disposed orbiting and non-orbiting scroll members 14 and 16 each of which include upstanding interleaved spiral wraps 18 and 20 which define moving fluid pockets 22, 24 which progressively decrease in size as they move inwardly from the outer periphery of the scroll members 14 and 16 in response to relative orbital movement between the scroll members 14 and 16.

A main bearing housing 26 is provided which is supported by outer shell 12 and which in turn movably supports orbiting scroll member 14 for relative orbital movement with respect to non-orbiting scroll member 16. Non-orbiting scroll member 16 is supported by and secured to main bearing housing for limited axial movement with respect thereto in a suitable manner such as disclosed in U.S. Pat. No. 5,407,335 issued Apr. 18, 1995 and assigned to the same assignee as the present application, the disclosure of which is hereby incorporated by reference.

A drive shaft 28 is rotatably supported by main bearing housing 26 and includes an eccentric pin 30 at the upper end thereof drivingly connected to orbiting scroll member 14. A motor rotor 32 is secured to the lower end of drive shaft 28 and cooperates with a stator 34 supported by outer shell 12 to rotatably drive shaft 28.

Outer shell 12 includes a muffler plate 36 which divides the interior thereof into a first lower chamber 38 at substantially suction pressure and an upper chamber 40 at discharge pressure. A suction inlet 42 is provided opening into lower chamber 38 for supplying refrigerant for compression and a discharge outlet 44 is provided from discharge chamber 40 to direct compressed refrigerant to the refrigeration system.

As thus far described, scroll compressor 12 is typical of such scroll-type refrigeration compressors. In operation, suction gas directed to lower chamber 38 via suction inlet 42 and is drawn into the moving fluid pockets 22 and 24 as orbiting scroll member 14 orbits with respect to non-orbiting scroll member 16. As the moving fluid pockets 22 and 24 move inwardly, this suction gas is compressed and subsequently discharged into discharge chamber 40 via a center discharge passage 46 in non-orbiting scroll member 16 and discharge opening 48 in muffler plate 36. Compressed refrigerant is then supplied to the refrigeration system via discharge outlet 44.

In selecting a refrigeration compressor for a particular application, one would normally choose a compressor having sufficient capacity to provide adequate refrigerant flow for the most adverse operating conditions to be anticipated for that application and may select a slightly larger capacity to provide an extra margin of safety. However, such "worst case" adverse conditions are rarely encountered during actual operation and thus this excess capacity of the compressor results in operation of the compressor under lightly loaded conditions for a high percentage of its operating time. Such operation results in reducing overall operating efficiency of the system. Accordingly, in order to improve the overall operating efficiency under generally encountered operating conditions while still enabling the refrigeration compressor to accommodate the "worst case" operating conditions, compressor 10 is provided with a capacity modulation system.

The capacity modulation system is generally of the type disclosed in U.S. Pat. No. 5,678,985 referred to above and includes an annular valving ring 50 movably mounted on non-orbiting scroll member 16, an actuating assembly 52 also supported on non-orbiting scroll member 16 and a control system 54 for controlling operation of the actuating assembly. However, the present invention incorporates valving ring 50 which has been modified from that previously disclosed to offer an improved sealing arrangement while allowing greater clearances which results in reduced manufacturing costs as well as a reduced potential for binding thereof during operation.

As best seen with reference to FIGS. 2 and 4–6, annular valving ring 50 comprises a generally circularly shaped main body portion 56 having a pair of generally radially inwardly extending protrusions 58 and 60 provided thereon positioned in substantially diametric relationship. A pair of openings 62 and 64 are also provided on main body portion 56 being spaced centrally between the upper and lower surfaces thereof and in generally diametrically opposed relationship to each other. Also, a pair of recesses 66, 68 are provided in the radially inwardly facing surface 70 of main body portion 56 in substantially diametrically opposed relationship. Substantially identical generally cup-shaped seals 72, 74 are disposed within each of the recesses 66, 68 and project outwardly in a radially inward direction therefrom so as to sealingly engage the peripheral surface of non-orbiting scroll member 16.

Main body 56 also includes a circumferentially extending stepped portion 88 which includes an axially extending circumferentially facing stop surface 90 at one end. A pin member 92 is also provided extending axially upwardly adjacent one end of stepped portion 78. Valving ring 50 may be fabricated from a suitable metal such as aluminum or alternatively may be formed from a suitable polymeric composition and pin 92 may be either pressed into a suitable opening provided therein or integrally formed therewith.

As best seen with reference to FIG. 6, cup-shaped seal 72 includes an annular lip portion 76 adapted to engage the annular sidewall 78 of recess 66 and cooperates therewith to define a cavity 80 therein. An annular radially extending flange 82 is also provided on seal 72 and is adapted to engage the peripheral sidewall 84 of non-orbiting scroll member 16. A relatively small centrally located opening 86 is provided in seal 72 which opens inwardly into cavity 80.

As previously mentioned, valving ring 50 is designed to be movably mounted on non-orbiting scroll member 16. In order to accommodate valving ring 50, non-orbiting scroll member 16 includes a pair of circumferentially extending groove portions 94, 96 formed on peripheral sidewall 84 adjacent the upper end thereof which are adapted to receive protrusions 58 and 60 and to cooperate therewith to support valving ring 50 as well as to guide rotational movement thereof. In order to enable valving ring 50 to be assembled to non-orbiting scroll member 16, a pair of diametrically opposed substantially identical radially inwardly extending notches 98 and 100 are provided in non-orbiting scroll member 16 each opening into one of respective grooves 94, 96 as best seen with reference to FIG. 3. Notches 98 and 100 have a circumferentially extending dimension slightly larger than the circumferential extent of protrusions 58 and 60 on valving ring 50 and respective grooves 94 and 96 have a circumferential length sufficient to fully accommodate rotational movement of valving ring 50. Preferably, respective notches 98 and 100 will be positioned such that protrusions 58 and 60 do not become fully aligned therewith during operational rotational movement of valving ring 50 so that respective grooves 98 and 100 and protrusions 58 and 60 will cooperate to support valving ring 50 on non-orbiting scroll member 16 to retain it in assembled relationship and to guide its rotational movement.

Non-orbiting scroll member 16 also includes a pair of generally diametrically opposed radially extending passages 102 and 104 opening outwardly through peripheral surface 84 and extending generally radially inwardly through the end plate of non-orbiting scroll member 16. An axially extending passage 106 places the inner end of passage 102 in fluid communication with moving fluid pocket 22 while a second axially extending passage 108 places the inner end of passage 92 in fluid communication with moving fluid pocket 24. Preferably, passages 106 and 108 will be oval in shape so as to maximize the size of the opening thereof without having a width greater than the width of the wrap of the orbiting scroll member 14. Passage 106 is positioned adjacent an inner sidewall surface of scroll wrap 20 and passage 108 is positioned adjacent an outer sidewall surface of wrap 20. Alternatively passages 106 and 108 may be round if desired however the diameter thereof should be such that the opening does not extend to the radially inner side of the orbiting scroll member 14 as it passes thereover.

In order to effect rotary movement of valving ring 50, actuating assembly 52 includes a piston 110 movably disposed within a cylinder housing 112. The outer end of piston 110 is connected to pin 92 and suitable fluid passages are provided in cylinder housing 112 to supply pressurized fluid to move piston 110 outwardly with respect thereto. A return spring 114 has one end connected to pin 92 and the other end connected to an upstanding pin associated with cylinder housing 112 and operates to effect return movement of piston 110 and valving ring 50 upon venting of the pressurized fluid being supplied to cylinder housing 112.

A suitable generally L-shaped fitting 116 is secured to shell 12 and extends outwardly therethrough, the outer end being adapted for connection to a fluid line 118. An enlarged diameter opening is provided at the inner end of fitting 116 and is adapted to receive one end of a resilient fluid coupling 120. The opposite end of fluid coupling 120 is received in an enlarged diameter opening 122 provided in housing 112 whereby fluid may be directed from fluid line 118 through fitting 116 and coupling 120 into cylinder housing 112. Suitable seals such as O-rings may be provided adjacent opposite ends of coupling 120 to ensure a fluid tight sealing relationship with enlarged diameter opening 122 and fitting 116. It should be noted that fluid coupling 120 is of a resilient material and is slidingly fitted within opening 122 and fitting 116 so as to accommodate the slight axial movement of non-orbiting scroll member 16 due to its axial compliant mounting arrangement.

Referring once again to FIG. 1, control system 54 includes a fluid line 124 having one end connected to discharge outlet 44 and the other end connected to a two way solenoid valve 126. Fluid line 118 forming a part of the control system is also connected to solenoid valve 126. A control module 128 is provided which serves to control operation of solenoid valve 126 in response to system operating conditions such as in response to signals received from thermostat 130 or other suitable sensors.

In operation, control module 128 will ensure that solenoid valve 126 is in a closed position thereby preventing fluid communication between fluid lines 124 and 118 during start up of the compressor. As a result, cylinder 112 of actuating assembly 52 will be vented to suction pressure in chamber 38 via internal passages provided in cylinder housing 112 thus enabling the force exerted by return spring 114 to maintain valving ring 50 in a position such as shown in FIG. 1 in which openings 62 and 64 are circumferentially aligned with passages 102 and 104. Thus, moving fluid pockets 22 and 24 will remain in fluid communication with lower chamber 38 at suction pressure via passages 106, 102 and 108, 104 after the initial sealing of the flank surfaces of the scroll wraps at the outer end thereof until such time as the moving fluid pockets have moved inwardly to a point at which they are no longer in fluid communication with passages 106 and 108. When valving ring 50 is in a position such that fluid passages 102 and 104 are in open communication with the suction gas chamber 38, the effective working length of scroll wraps 18 and 20 is reduced as is the compression ratio and hence capacity of the compressor. It should be noted that the degree of modulation or reduction in compressor capacity may be selected within a given range based upon the positioning of passages 106 and 108. These passages may be located so that they are in communication with the respective suction pockets at any point up to about 360° inwardly from the point at which the trailing flank surfaces move into sealing engagement. If they are located further inwardly than this, compression of the fluid in the pockets will have begun and hence venting thereof will result in lost work and a reduction in efficiency.

It should also be noted that by ensuring passages 102 and 104 are in open communication with suction pressure at start up, the required starting torque for the compressor is substantially reduced. This enables the use of a more efficient lower starting torque motor, thus further contributing to overall system efficiency.

In any event, so long as system conditions as received by control module 128 indicate, compressor 10 will continue to operate in this reduced capacity mode. However, should system conditions dictate that additional capacity is required such as may be indicated by a signal from thermostat 130 to controller 128, controller 128 will actuate solenoid valve 126 to an open position thus directing fluid at discharge pressure from discharge outlet 44 to cylinder housing 112 via fluid lines 124, 118, fitting 116, coupling 120. The force resulting from the supplying of discharge pressure fluid to cylinder housing 112 will overcome the force exerted by spring 114 thereby driving piston 110 outwardly from cylinder housing 112 and causing valving ring to rotate in a clockwise direction as shown in FIG. 3 until stop surface 90 moves into engagement with abutment surface 132 provided on cylinder housing 112. With valving ring 50 in this position, seals 72 and 74 will be positioned in overlying relationship to respective passages 102 and 104 thereby preventing venting of the compression pockets 22 and 24 and restoring the compressor to full capacity.

As best seen with reference to FIG. 6, central opening 86 will allow a small amount of pressurized fluid to flow from respective passages 102 and 104 into cavity 80. This pressurized fluid will operate to bias annular lip 76 into a fluid tight sealing relationship with sidewalls 78 of recess 66 as well as urging seal 72 outwardly with respect thereto and thus ensuring a fluid tight seal between peripheral surface 84 and flange 82. In addition to pressure in the cavity biasing the valve into sealing engagement, movement of the valve into sealing relation will also be aided by the static pressure created by initial gas leakage past the sealing flange 84 which static pressure will be lower than the pressure in the cavity.

Seals 72 and 74 may be easily fabricated from any suitable and preferably somewhat resilient low friction material such as for example Teflon® which is a polytetrafluoroethylene plastic material. A low friction material is preferred as it will aid in minimizing the resistance to movement of valving ring 50 although other suitable materials may be utilized.

FIG. 7 illustrates another form of seal which may be used in place of seals 72 and 74. Seal 134 comprises a relatively stiff center portion 136 which is generally flat in cross section and includes an annular outwardly projecting sealing flange portion 138. In this embodiment, the diameter of recess 140 is substantially greater than recess 66 and seal 134 is secured therein by means of a suitable flexible annular diaphragm 142 or O-ring which is secured at its radial inner surface to seal member 134 and at its radial outer edge to the periphery of sidewall 144 defining recess 140 so as to thereby define a substantially closed cavity 146. A center opening 148 is provided in center portion 136 of seal 134 which opens into cavity 146 and enables pressurized fluid from respective passages 102, 104 to flow into and pressurize cavity 146. Because the surface area of seal 134 and diaphragm 142 exposed to the pressurized fluid in cavity 146 when valving ring is moved to a position in which seal 134 overlies passage 102 in non-orbiting scroll member is greater than the area enclosed within flange 138, there will be a differential pressure biasing the seal into sealing relationship with the peripheral surface 84 of non-orbiting scroll member 16 as noted above. The actual sealing force resulting therefrom can easily be controlled by selecting the relative sizes of the surfaces exposed to the pressure in cavity 146 relative to the surface area enclosed within annular flange 138.

Figure 8:
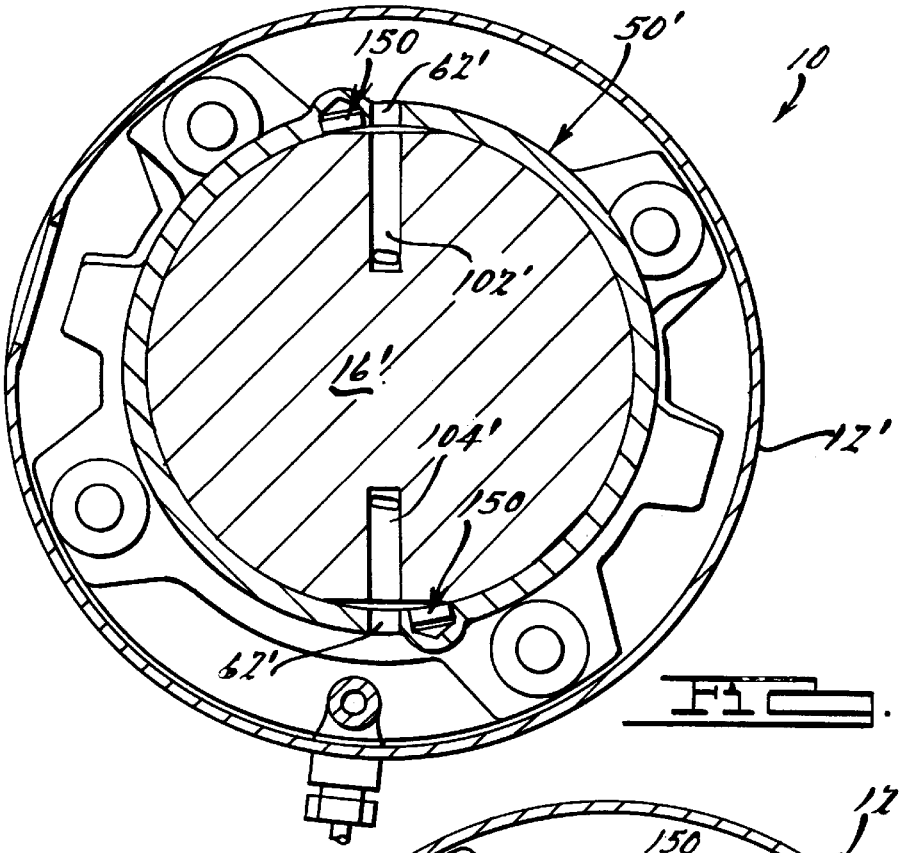
FIG. 8 is a section view of the compressor of FIG. 1 but showing yet another embodiment of the valve ring, the section being taken along a horizontal plane passing through a center portion of the valving ring.
Figure 9:
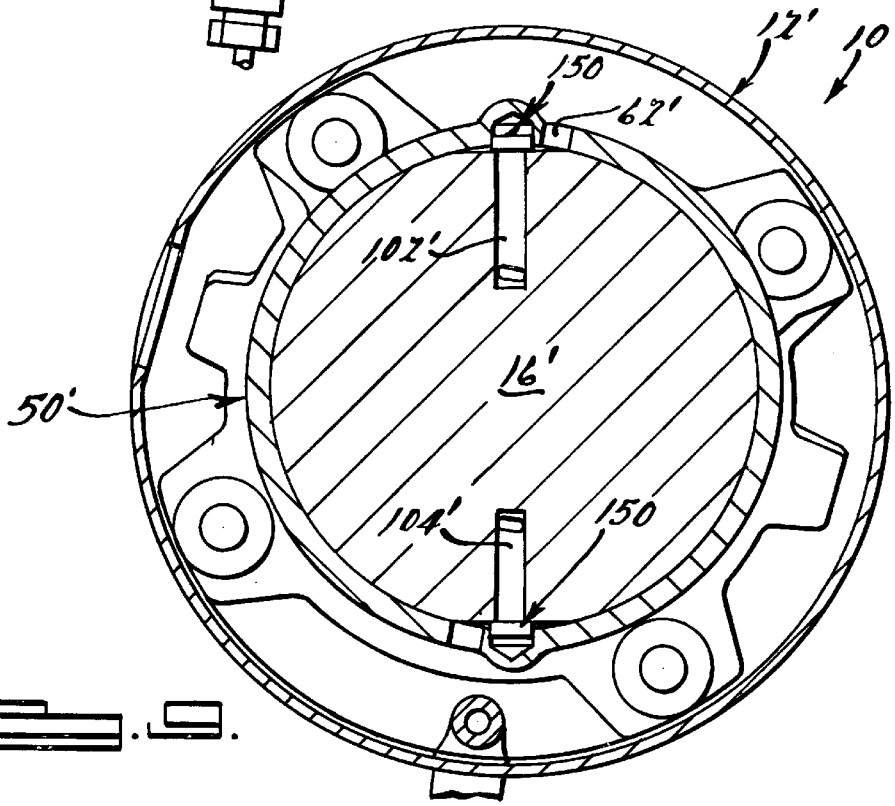
FIG. 9 is a view of the embodiment of FIG. 8 with the valve ring shown in a closed position.

Another modified sealing arrangement is shown in FIGS. 8–10 in which elements corresponding to elements previously described are indicated by the same reference numbers primed. In this embodiment, seals 150 are in the form of an annular ring having a U-shape in cross section including radially inner and outer axially elongated walls 156 and 154 and an axially outer (with respect to recess 66') interconnecting portion 156. As shown, radially outer wall 154 is slidingly seated against sidewall 78' of recess 66' and when compressor 10' is in a fully loaded mode of operation (i.e., vent passages 102' and 104' are closed off) the pressurized fluid within passage 102' will enter cavity 80' through the open center of seal 150 and will act against the inner surfaces of radially outer wall 154 and interconnecting portion 156 to bias them into sealing engagement with sidewall 78' and peripheral surface 84' in substantially the same manner as described above.

Also in this embodiment, a flat 158 is machined on the peripheral surface 84' of non-orbiting scroll 16 in the area surrounding vent passage 102'. The provision of flat 158 enhances the ability of seal 150 to seat against this surface and may also reduce the biasing force required to obtain a secure seal as compared to the engagement of seals 72 or 134 with the curved peripheral surface 84 of the previous embodiments. It should be noted that a flat may also be incorporated into the previously described embodiments if desired. Also, by reducing the force required to establish a substantially leak-free seal, the resistance to movement of valving ring 50 into a reduced capacity mode will also be reduced thereby enabling use of a smaller piston cylinder actuator for operation of same.

While each of the above embodiments has placed the seal member in a recess provided on the valving ring, it is also possible to position the valve member in a recess provided on the non-orbiting scroll member. Embodiments illustrating such a construction are shown in FIGS. 11 and 12.

As shown in FIG. 11, a relatively shallow enlarged diameter bore or recess 160 is provided in the peripheral surface 84" of the non-orbiting scroll member 16', being located in substantially coaxial relationship to vent passage 102'. Additionally, the outer end 162 of vent passage 102' is generally conically shaped to enlarge in an outward direction to a size slightly less than the diameter of recess 160 so as to define an annular ledge 164 at the junction thereof.

Seal 150' is substantially identical to seal 150 shown in FIGS. 8–10 and includes radially inner and outer sidewalls 154', 152' and an axially outer interconnecting portion 156'. The axially inner edge of radially outer sidewall 154' is seated on ledge 164 with the radially inner sidewall 152' slightly overhanging the opening defined by the conical portion 164 of vent passage 102'.

While seal 150' could seal against the radially inwardly facing curved surface of valving ring 166, this embodiment is illustrated with valving ring 166 having a flat 168 machined on the radially inwardly facing surface thereof. Preferably flat 168 will be positioned so that it is perpendicular to the axis of passage 102' when valving ring 166 is in a position as shown in FIG. 11 at which the compressor is operating at full capacity (i.e. vent passage 102' is fully closed off). Additionally, flat 168 has a length in the circumferential direction sufficient so as to accommodate rotational movement of valve ring into a position in which the axis of opening 170 is substantially aligned with the axis of vent passage 102'.

In operation, as valving ring 166 rotates into a position to close off vent passage 102', flat 168 will move into substantially perpendicular relationship with the axis of passage 102' and also into sealing contact with seal. The inner cavity 170 of seal 150' is in fluid communication with the pressurized fluid flowing through vent passage 102' and will define a stagnation area such that the pressurized fluid will operate to both bias the radially outer sidewall 154' into fluid tight sealing engagement with the opposed sidewall 172 of recess 160 as well as to bias seal axially outwardly into fluid tight sealing engagement with flat 168. On the other hand, as valving ring 166 rotates into a position to open vent passage 102' to suction pressure, flat 168 will be moved both circumferentially and somewhat outwardly away from seal 150' until such time as opening 174 begins to overlap the open center area of seal 150'. At this point in time, the venting of pressurized fluid from passage will begin with an attendant relaxation of the biasing force urging seal 150' into engagement with flat 168 such that resistance to further movement of valving ring 166 in the unloading direction is reduced. Additionally, as the biasing force is reduced, the wear on seal 150' resulting from the movement of valving ring 166 is also reduced.

FIG. 12 illustrates another embodiment in which a spring 176 is incorporated being fitted within cavity 170' of seal 150" and seating against ledge 164'. Spring 176 operates to exert at least an initial biasing force on seal to urge it into engagement with flat which may be desirable in some applications and if desired may provide the primary biasing force to effect sealing. The construction and operation of seal 150" is otherwise substantially identical to that described above with reference to FIG. 11 and accordingly corresponding portions of FIG. 12 are indicated by the same reference numbers primed. It should be noted that as shown in FIG. 12, it is possible to delete the conical outer portion 162 provided in the embodiment of FIG. 11 if desired although such a surface may be incorporated therein if desired.

As may now be fully appreciated, the provisions of seals on the valving ring in accordance with the present invention greatly facilitates operation of the capacity modulation system while also substantially reducing the costs required for high tolerance machining of the valving ring. Additionally, because of the ability to provide adequate clearances for easy movement of the valving ring, the forces required to effect same will be substantially reduced thus enabling use of a smaller piston cylinder assembly as well as a weaker return spring.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

We claim:

1. A capacity modulation system for a scroll-type compressor comprising:

a first scroll member having a first end plate and a first spiral wrap upstanding therefrom;

a second scroll member having a second end plate and a second spiral wrap upstanding therefrom, said first and second spiral wraps being interleaved to define at least two moving fluid pockets which decrease in size as they move from a radially outer position to a radially inner position;

a fluid passage having one end opening into one of said moving fluid pockets and a second end opening outwardly along a peripheral surface of one of said first and second end plates;

a valving ring having an opening therein and being rotatably supported on said one of said first and second end plates for movement of said opening into and out of overlying relationship to said second end; and a seal supported on one of said end plates and said valving ring and sealingly engageable with the other of said valving ring and said end plate to prevent fluid flow through said fluid passage when said valving ring is in overlying relationship to said passage.

2. A capacity modulation system as set forth in claim 1 wherein said seal includes a biasing surface, and pressurized fluid flowing through said passage acts on said biasing surface to bias said seal into sealing engagement with said other of said valving ring and said end plate.

3. A capacity modulation system as set forth in claim 2 wherein said seal is supported on said valving ring.

4. A capacity modulation system as set forth in claim 3 wherein said seal is disposed within a recess, said recess and said seal cooperating to define a substantially closed cavity and said seal member includes a central opening for admitting pressurized fluid from said passage into said cavity.

5. A capacity modulation system as set forth in claim 4 wherein said seal includes first and second sides, said first side including a first surface area against which pressurized fluid in said cavity acts, said second side including a second surface area against which said pressurized fluid in said passage acts, said first surface area being greater than said second surface area.

6. A capacity modulation system as set forth in claim 4 wherein said seal includes a seal sidewall engageable with a recess sidewall of said recess, said pressurized fluid urging said seal sidewall into engagement with said recess sidewall.

7. A capacity modulation system as set forth in claim 4 wherein said seal includes an annular flexible member extending between said seal and a sidewall of said recess.

8. A capacity modulation system as set forth in claim 7 wherein said flexible member is a diaphragm.

9. A capacity modulation system for a scroll-type compressor comprising:

a first scroll member having a first end plate and a first spiral wrap upstanding therefrom;

a second scroll member having a second end plate and a second spiral wrap upstanding therefrom, said first and second spiral wraps being interleaved to define at least two moving fluid pockets which decrease in size as they move from a radially outer position to a radially inner position;

a fluid passage having one end opening into one of said moving fluid pockets and a second end opening outwardly along a peripheral surface of one of said first and second end plates;

a valving ring rotatable supported on a generally cylindrical sidewall portion of one of said first and second end plates for movement into and out of overlying relationship to said second end; and a seal supported on one of said end plates and said valving ring and sealingly engageable with the other of said valving ring and said end plate to prevent fluid flow through said fluid passage when said valving ring is in overlying relationship to said passage.

10. A capacity modulation system for a scroll-type compressor comprising:

a first scroll member having a first end plate and a first spiral wrap upstanding therefrom;

a second scroll member having a second end plate and a second spiral wrap upstanding therefrom, said first and second spiral wraps being interleaved to define at least two moving fluid pockets with decrease in size as they move from a radially outer position a radially inner position;

a fluid passage having one end opening into one of said moving fluid pockets and a second end opening outwardly along a peripheral surface of one of said first and second end plates;

a valving rotatably supported on a generally cylindrical sidewall postion of one of said first and seond end plates for movement into and out of overlying relationship to said second end; and a seal supported on one of said end plates and said valving ring and sealingly engageable with the other of said valving ring and said end plate to prevent fluid flow through said fluid passage when said valving ring is in overlying relationship to said passage.

11. A capacity modulation system as set forth in claim 10 wherein said radially inner and outer wall portions and said end wall portion define an open ended cavity, pressurized fluid from said passage acting within said cavity to bias said end wall portion into sealing engagement with said other of said valving ring and said end plate.

12. A capacity modulation system as set forth in claim 11 wherein said seal is disposed in a recess having a sidewall, said pressurized fluid biasing said radially outer wall portion into sealing engagement with said recess sidewall.

13. A scroll-type refrigeration compressor comprising:

a first scroll member having a first end plate and a first spiral wrap upstanding therefrom;

a second scroll member having a second end plate and a second spiral wrap upstanding therefrom, said first and second spiral wraps being interleaved to define at least two moving fluid pockets which decrease in size as they move from a radially outer position to a radially inner position;

stationary body supporting said second scroll member for orbital movement with respect to said first scroll member, said first scroll member being supportingly secured to said stationary body;

a drive shaft rotatably supported by said stationary body and drivingly coupled to said second scroll member;

a driving motor operative to rotatably drive said drive shaft;

a first fluid passage provided in said first scroll member and extending generally radially from a first fluid pocket and opening outwardly along an outer peripheral surface of said first scroll member;

a second fluid passage provided on said first scroll member and extending generally radially from a second fluid pocket and opening outwardly along an outer peripheral surface of said first scroll member, in circumferentially spaced relationship from said first passage;

an annular valve ring rotatably supported on said peripheral surface in radially spaced overlying relationship to said openings of said first and second passages, said valve ring including first and second radially inwardly facing seals movably disposed within recesses provided on said valving ring, said seals being movable into and out of overlying relationship with respect to said first and second openings respectively to close and open said passages; and an actuating assembly supported on said first scroll member, said actuating assembly being operable to effect rotary movement of said valve ring with respect to said first scroll member to thereby move said first and second seals into and out of overlying relationship with said openings whereby the capacity of said compressor may be modulated.

14. A scroll-type refrigeration compressor as set forth in claim wherein said seals include biasing surfaces, and fluid pressure from said first and second fluid passages acts on said biasing surface to bias respective of said first and second seals into sealing engagement with said peripheral surface of said first scroll member.

15. A scroll-type refrigeration compressor as set forth in claim 14 wherein said valving ring includes first and second recesses, said first and second seals being secured to sidewalls of said first and second recesses.

16. A scroll-type refrigeration compressor as set forth in claim 14 wherein said first and second seals are in the form of an annular torus, said torus being generally U-shaped in cross section.

17. A scroll-type refrigeration compressor as set forth in claim 16 wherein said generally U-shaped annular torus defines a cavity therein, said pressurized fluid acting in said cavity to bias said seal.

18. A scroll-type refrigeration compressor as set forth in claim 13 wherein said peripheral surface of said first scroll member includes a flat surface area surrounding each of said openings, said seal engaging said flat to close said passages.

19. A scroll-type compressor having a capacity modulation system comprising:

a first scroll member having an end plate and a first spiral wrap upstanding therefrom;

a second scroll member having an end plate and a second spiral wrap upstanding therefrom, said first and second spiral wraps being interleaved to define at least two moving fluid pockets which decrease in size as they move from a radially outer position to a radially inner position in response to relative orbital movement between said first and second scroll members;

a first fluid passage provided in said first scroll member and extending generally radially outwardly from a first fluid pocket to a first outer end opening outwardly along a peripheral surface of said first end plate;

a second fluid passage provided in said first scroll member and extending generally radially outwardly from a second fluid pocket to a second outer end opening outwardly along said peripheral surface in circumferentially spaced relationship from said first fluid passage;

a valving ring movably supported on said peripheral surface;

first and second seals supported on said peripheral surface in surrounding relationship to respective of said first and second outer ends;

said valving ring being movable into and out of a position in which said valving ring sealingly engages each of said first and second seals to thereby close and open respectively said first and second fluid passageways whereby the capacity of said compressor may be modulated.

20. A scroll-type compressor as set forth in claim 19 wherein said valving ring is rotatably supported on said peripheral surface.

21. A scroll-type compressor as set forth in claim 19 wherein said valving ring includes a radially inner surface having first and second flats thereon, said flats being positioned in substantially perpendicular relationship to the axis of said first and second fluid passages when said valving ring is in a position to close said first and second fluid passageways.

22. A scroll-type compressor as set forth in claim 21 wherein said valving ring includes first and second openings therethrough, said first and second openings being movable into substantially aligned relationship with said first and second fluid passageways when said valving ring is in a position to open said first and second fluid passageways.

23. A scroll-type compressor as set forth in claim 22 wherein said first and second openings are positioned along said first and second flats.

24. A scroll-type compressor as set forth in claim 19 wherein said first and second ends each include an enlarged diameter bore extending inwardly from said peripheral surface, said first and second seals being seated in respective of said bores.

25. A scroll-type compressor as set forth in claim 24 further comprising conical shaped portions interconnecting said first and second fluid passages with respective of said enlarged diameter bores.

26. A scroll-type compressor as set forth in claim 24 further comprising springs associated with each of said first and second seals, said springs being operative to bias said seals into engagement with said valving ring.

* * * * *

UNITED STATES PATENT AND TRADEMARK OFFICE

CERTIFICATE OF CORRECTION

PATENT NO. : 6,116,867
DATED : September 12, 2000
INVENTOR(S) : Frank S. Wallis et al

It is certified that error appears in the above-identified patent and that said Letters Patent is hereby corrected as shown below:

Column 9, line 62, "rotatable" should be -- rotatably --.

Column 10, lines 4-26, delete Claim 10 in its entirety.

Column 10, line 47, before "stationary" insert -- a --.

Column 11, line 16, after "claim" insert -- 13 --.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*